US005209592A

United States Patent [19]

Bedol

[11] Patent Number: 5,209,592

[45] Date of Patent: May 11, 1993

[54] NOTEBOOK INSERT WITH CALCULATOR AND HOLEPUNCH

[76] Inventor: Mark A. Bedol, 6980 Fabriano Pl., Rancho Cucamonga, Calif. 91701

[21] Appl. No.: 804,762

[22] Filed: Dec. 9, 1991

[51] Int. Cl.[5] ..... B42F 3/00

[52] U.S. Cl. ..... 402/1; 402/4; 30/123

[58] Field of Search ..... 402/1, 4, 80; 281/30, 281/51, 15.1, 42; 30/123

[56] References Cited

U.S. PATENT DOCUMENTS

| | | | |
|---|---|---|---|
| 2,105,233 | 1/1938 | Schade | 402/1 |
| 4,075,702 | 2/1978 | Davies | 281/30 X |
| 4,729,688 | 3/1988 | Manz | 402/1 |
| 4,832,191 | 5/1989 | Gerver et al. | 281/15.1 X |
| 4,918,632 | 4/1990 | York | 402/4 |
| 5,093,760 | 3/1992 | Bedol | 281/42 |

OTHER PUBLICATIONS

Jacobs Gardner, Office Supply Catalog, 1990, p. 1024.

*Primary Examiner*—Mark Rosenbaum
*Assistant Examiner*—Willmon Fridie, Jr.

[57] ABSTRACT

A notebook insert comprises a housing, an electronic calculator attached to the housing and a holepunch assembly also attached to the housing. The housing has a periphery with multiple holes therethrough which are spaced to be adapted for engagement with the rings of a ringed notebook. The housing, electronic calculator, and holepunch assembly are sufficiently thin for convenient use of the notebook insert in a ringed notebook.

6 Claims, 2 Drawing Sheets

NOTEBOOK INSERT WITH CALCULATOR AND HOLEPUNCH

BACKGROUND OF THE INVENTION

1. Field of the Invention

The present invention relates to inserts for notebooks and more particularly to a notebook insert which is securable to the rings of a notebook and provided with an electronic calculator and a holepunch mechanism.

2. Description of the Related Art

Users of notebooks, including businessmen and students, often desire to have a calculator at their disposal to perform mathematical calculations. Additionally, these notebook users often have the need to have a holepunch at their ready disposal. However, these holepunches and calculators are easily misplaced, especially while being transported, for example between school, the home, and/or the office.

In partial solution to this problem, present applicant Mark A. Bedol, invented a "Notebook Organizer Including Slidable Element", U.S. Pat. No. 5,050,736. The '736 patent discloses an organizer comprising a base with holes for engagement with the rings of a ringed notebook. The base includes a plurality of partitions which divide the base into a plurality of compartments. The patent also discloses an electronic calculator having a longitudinal extension thereon being slidably engageable with, and supported between, opposing partition surfaces.

U.S. Pat. No. 2,194,003 issued, to D. K. Brooks, entitled "Article Holder for Loose-Leaf Notebooks", discloses a device for holding pens, pencils and numerous other writing and drawing implements. U.S. Pat. No. 4,918,632, issued to D. C. York, entitled "Notebook Mountable Computer System", discloses a portable computer unit contained within a substantially planar housing having a minimal thickness designed for transport in a ring-type notebook binder. U.S. Pat. No. 3,126,891, issued to A. A. Caputi, entitled "Loose-Leaf Binder Container for Pencils and the Like", discloses a receptacle for articles of stationary such as pens, pencils, erasers and the like. U.S. Pat. No. 2,318,192, issued to J. Boelema Jr., entitled "Combination Loose-Leaf Notebook, Paper Container and Accessory Kit", discloses another notebook organizer which provides storage space for various accessories.

None of the aforementioned patents provide an efficient, space-saving inexpensive means for containing, within a notebook binder, both an electronic calculator and a holepunch.

SUMMARY OF THE INVENTION

A notebook insert is disclosed which is sufficiently thin for convenient use in a ringed notebook. In its broadest aspects, the notebook insert comprises a housing, an electronic calculator and a holepunch assembly. The housing includes a periphery with a plurality of holes therethrough. The holes are adapted for engagement with the rings of a ringed notebook. The electronic calculator is attached to the housing. The holepunch assembly is also attached to the housing.

In its more narrow aspects, the housing includes a plurality of spaced openings, the holepunch assembly comprising a rigid plate having spaced projections formed thereon and means for securely attaching the rigid plate to the housing. The holepunch assembly is so positionable with respect to an upper surface of the housing such that the spaced extensions may be aligned with the openings so as to provide a holepunching capability when paper is inserted therebetween.

Other objects, advantages and novel features of the present invention will become apparent from the following detailed description when considered in conjunction with the accompanying drawings.

BRIEF DESCRIPTION OF THE DRAWINGS

The same elements or parts throughout the figures of the drawings are designated by the same reference characters.

DETAILED DESCRIPTION OF THE PREFERRED EMBODIMENTS

Figure 1:
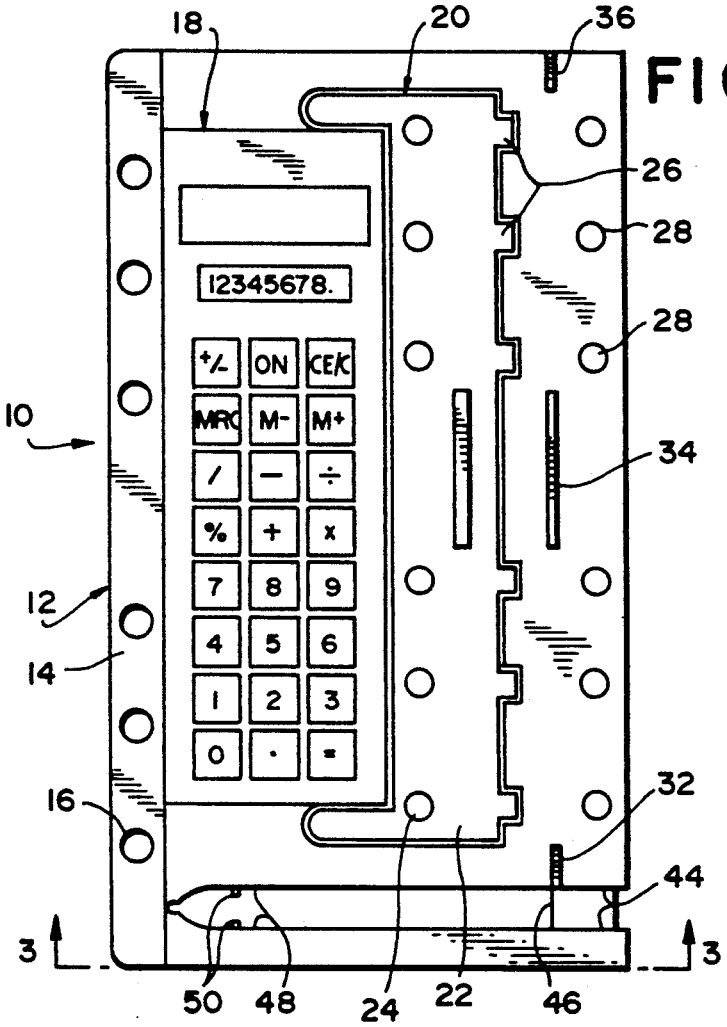
FIG. 1 is a front view of the notebook insert of the present invention.

Referring to the drawings and the characters of reference marked thereon, FIG. 1 illustrates the notebook insert of the present invention, designated generally as 10. The notebook insert 10 includes a housing, designated generally as 12, with a periphery or border 14 on its left side with holes 16 for engagement with rings of a conventional ringed binder (not shown).

Centered within the left side of the housing 12 is an electronic calculator 18. Calculator 18 is preferably built into housing 12.

To the right of the electronic calculator 18 is located a holepunch assembly 20. Holepunch assembly 20 comprises a rigid plate 22 having spaced projections 24 formed thereon. The rigid plate 22 is preferably attached to housing 12 by hinges 26. Housing 12 includes spaced openings 28 o its right periphery. Thus, rigid plate 22 can be turned via hinges 26 so that spaced projections 24 become aligned with openings 28, thereby providing a holepunching capability when paper is inserted therebetween.

Figure 4:
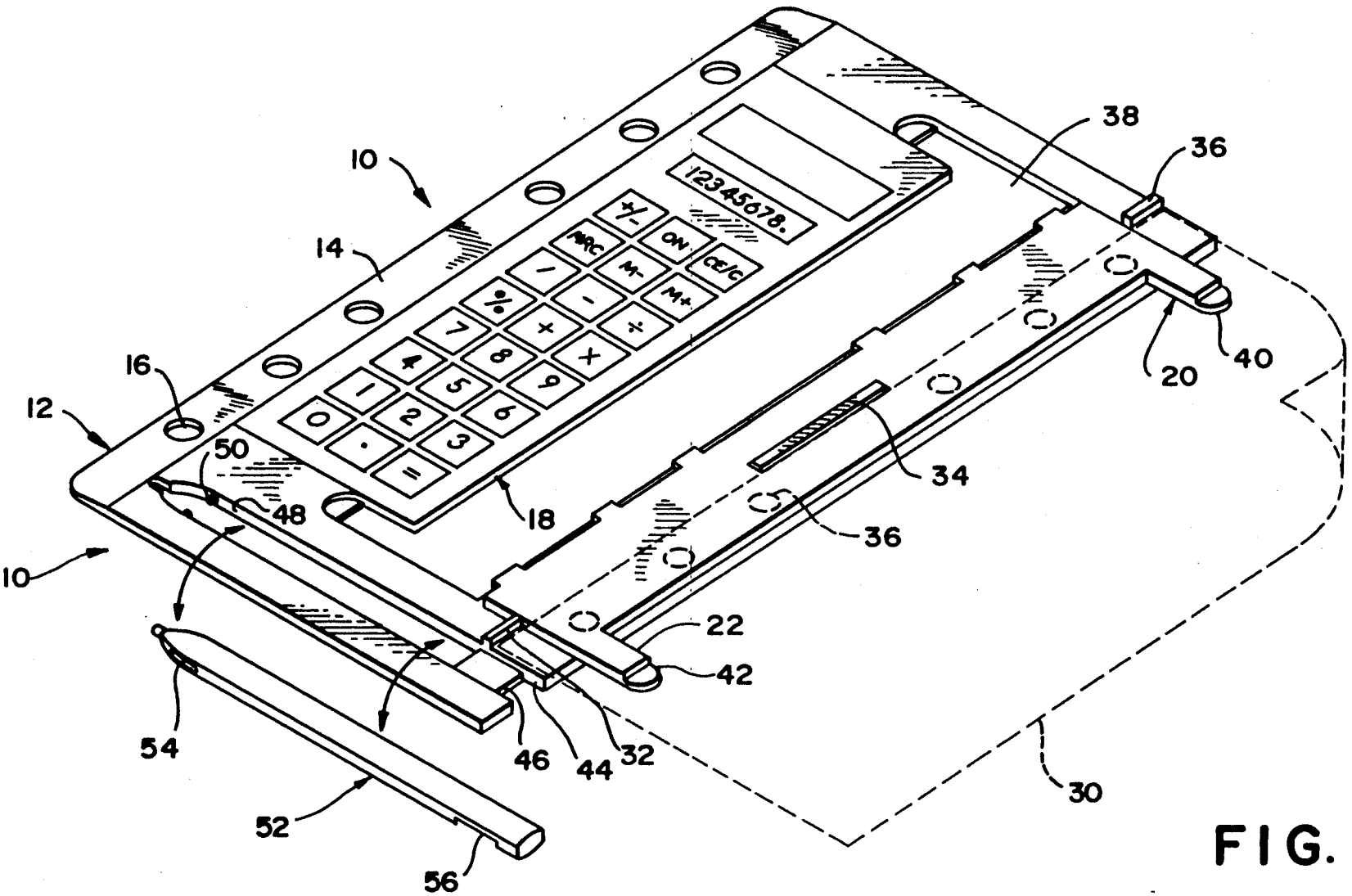
FIG. 4 is a perspective view of the notebook insert, illustrating the use of the holepunch assembly.

Referring now to FIG. 4 such a holepunching capability is illustrated. A piece of paper, illustrated by phantom lines 30, is shown inserted within the holepunch assembly 20. Paper 30 is pushed along the right side of the upper surface of housing 12 until it abuts lower positioning extension 32, central positioning extension 34, and upper positioning extension 36. The rigid plate 22 is then moved from the stowed position shown in FIG. 1 to the position shown in FIG. 4 to punch holes in the paper, as illustrated in phantom line openings 36 in FIG. 4.

A recessed portion 38 of the upper surface of the housing 12 (best seen in FIG. 4) provides a substantially smooth insert 10 upper surface when the holepunch assembly 20 is in the stowed position (FIG. 1) i.e., an upper surface of the rigid plate is maintained substantially flush with the unrecessed portions of the upper surface of he housing. The rigid plate 22 includes an upper lateral extension 40 and lower lateral extension 42 which provide easy manipulation of the rigid plate 22.

Figure 2:
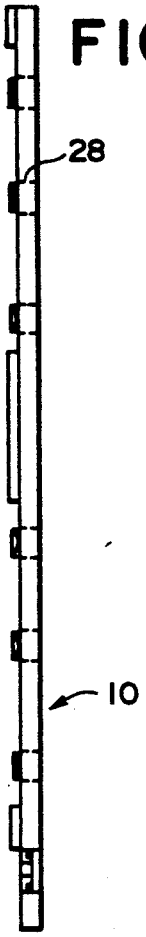
FIG. 2 is a side view of the notebook insert, partially in cross-section, taken along line 2—2 of FIG. 1.
Figure 3:
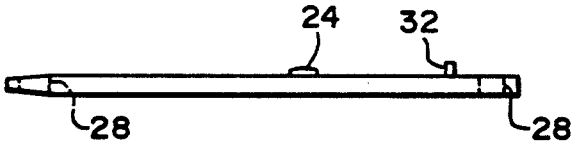
FIG. 3 is a bottom end view of the notebook insert, taken along line 3—3 of FIG. 1.

As can be seen in FIGS. 2 and 3 utilization of the principles of the present invention provide the ability to have a very thin notebook insert which is convenient and very useful. Insert 10 has a height of between approximately 2/32 inch and ¼ inch. It is preferably formed of a glass or metal filled plastic; however, it may be formed of a plastic material.

Figure 5:
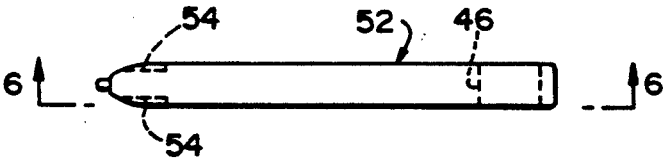
FIG. 5 is a top view of a writing instrument particularly adapted for use with the notebook insert of the present invention.
Figure 6:
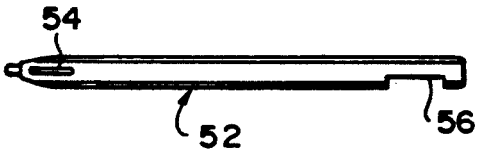
FIG. 6 is a side view of the writing instrument, taken along line 6—6 of FIG. 5.

Notebook insert 10 also preferably includes the capability of attaching writing instruments thereto. The housing 12 includes a cutaway section near its lower end. Two opposing lower surfaces 44 form part of that cutaway section and are bridged by a step down back plate 46. Two opposing upper surfaces 48 of the cutaway section include respective opposing horizontal guide pins 50 formed thereon. Guide pins 50 and step down back plate 46 serve to secure a writing instrument 52. FIG. 5 illustrates a top view of writing instrument 52 while FIG. 6 illustrates a side view thereof. Writing instrument 52, which may, for example, be a pen includes two longitudinal grooves 54 located on upper side surfaces thereof for engaging the guide pins 50 of housing 12. Writing instrument 52 further includes a notch 56 formed in a back, lower surface thereof for engaging the step down back plate 46. Thus, in use, the front of the writing instrument 52 is secured to the guide pins 50. Then, the back end of the writing instrument 52 is pushed or snapped down to lock in the back end of the writing instrument 52.

Obviously, many modifications and variations of the present invention are possible in light of the above teachings. It is therefore to be understood that, within the scope of the appended claims, the invention may be practiced otherwise than a specifically described.

What is claimed and desired to be secured by Letters Patent of the United States is:

1. A notebook insert, comprising:

a) a housing having a periphery with a plurality of holes therethrough, said holes being adapted for engagement with the rings of a ringed notebook;

b) an electronic calculator attached to said housing; and, c) a holepunch assembly attached to said housing, said housing, calculator and holepunch assembly being sufficiently thin for convenient use of the notebook insert in a ringed notebook, wherein said housing includes a plurality of spaced openings, said holepunch assembly comprising a rigid plate having spaced projections formed thereon and hinges attached to an edge thereof, said hinges for securely attaching said rigid plate to said housing, said rigid plate being so positionable with respect to an upper surface of said housing such that said spaced extensions may be aligned with said openings so as to provide a holepunching capability when paper is inserted therebetween.

2. The notebook insert of claim 1 wherein said housing comprises a recessed portion on said upper surface thereof, substantially matching the shape of said rigid plate, so that when the holepunch assembly is in a stowed position it may be supported within said recessed portion, an upper surface of said rigid plate being maintained substantially flush with the unrecessed portions of the upper surface of said housing.

3. The notebook insert of claim 2 wherein said rigid plate includes an upper lateral extension and a lower lateral extension, said electronic calculator being positioned therebetween when said holepunch assembly is in said stowed position.

4. The notebook insert of claim 2 wherein said housing further includes a plurality of vertical positioning extensions depending from said housing upper surface and located at positions so as to allow proper positioning of paper relative to said notebook insert during operation of said holepunch assembly.

5. The notebook assembly of claim 4 wherein said notebook insert further includes means for securing a writing instrument thereto.

6. The notebook insert of claim 5 wherein said means for securing said writing instrument includes a cutaway section formed within said housing, two opposing lower surfaces, forming part of said cutaway section, being bridged by a step down back plate, and two opposing upper surfaces, forming another part of said cutaway section having respective opposing horizontal guide pins formed thereon, said notebook insert further including a writing instrument having two longitudinal grooves located on upper side surfaces thereof for engaging said guide pins, said writing instrument further including a notch formed in a back, lower surface thereof for engaging said step down back plate.

* * * * *